US009103144B2

(12) United States Patent
Liang et al.

(10) Patent No.: US 9,103,144 B2
(45) Date of Patent: Aug. 11, 2015

(54) DOOR TRAVEL LIMITING DEVICE

(71) Applicants: Luke Liang, So. Plainfield, NJ (US); Tong Liang, Guang Zhou (CN); David Chen, Guang Zhou (CN)

(72) Inventors: Luke Liang, So. Plainfield, NJ (US); Tong Liang, Guang Zhou (CN); David Chen, Guang Zhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 60 days.

(21) Appl. No.: 14/090,124

(22) Filed: Nov. 26, 2013

(65) Prior Publication Data

US 2015/0143664 A1 May 28, 2015

(51) Int. Cl.
*E05F 5/04* (2006.01)
*E05C 19/06* (2006.01)

(52) U.S. Cl.
CPC ..... *E05C 19/06* (2013.01)

(58) Field of Classification Search
CPC ... E05C 17/48; E05C 17/446; E05B 65/0864; E05B 65/087; E05B 65/0888; E05B 15/10; E05B 15/01; E05Y 2201/218; E05Y 2201/224; E05Y 2201/212; E05F 2700/02; E05F 2700/04
USPC ..... 16/82, 85, 86 R, 86 A; 70/131, 143, 144, 70/145, 93; 292/340, 341.15, 341.19, 229, 292/271, 272, 273, 163, 164, 174, 175, 60, 292/62, DIG. 15, DIG. 4, DIG. 19
See application file for complete search history.

(56) References Cited

U.S. PATENT DOCUMENTS

| | | | | | |
|---|---|---|---|---|---|
| 368,595 | A | | 8/1887 | King | |
| 447,068 | A | | 2/1891 | Dixon | |
| 698,742 | A | | 4/1902 | Scharnweber | |
| 760,528 | A | * | 5/1904 | Davies | 292/60 |
| 776,178 | A | * | 11/1904 | Guedeney et al. | 292/60 |
| 1,244,725 | A | | 10/1917 | Gadke | |
| 1,622,791 | A | | 3/1927 | Lang | |
| 1,877,177 | A | | 9/1932 | Hinderer | |
| 1,940,084 | A | | 12/1933 | Grasso | |
| 2,735,707 | A | | 2/1956 | Sylvan | |
| 2,929,647 | A | | 3/1960 | Gladstone | |
| 3,055,064 | A | | 9/1962 | Riegelman | |
| 3,330,585 | A | | 7/1967 | Pollin | |
| 3,608,940 | A | | 9/1971 | Mueller | |
| 3,869,887 | A | | 3/1975 | Zeit | |
| 3,930,678 | A | | 1/1976 | Alexander | |
| 3,975,041 | A | | 8/1976 | Edison | |
| 4,050,723 | A | * | 9/1977 | Papadatos | 292/164 |
| 4,089,083 | A | * | 5/1978 | Wilde et al. | 16/82 |
| 4,102,545 | A | | 7/1978 | Jay | |

(Continued)

*Primary Examiner* — Chuck Mah
(74) *Attorney, Agent, or Firm* — Thomas A. O'Rourke; Bodner & O'Rourke, LLP

(57) ABSTRACT

A door travel limiting device includes a housing, a stop member, a compression spring, and a flexible member. The stop member is slidably received by the housing, and is slidable in first and second sliding directions, and has first and second ends respectively extending outwardly from different portions of the housing. The stop member is biased to slide in the first sliding direction, causing a portion proximate to its second end to normally retract into the housing. Extreme sliding positions of the stop member are limited by protrusions. A flexible member protrudes from the stop member to selectively engage portions of a housing track, to retain the second end of the stop member at an intermediate position between its first and second positions, when the stop member is first actuated to slide from the first position to the second position, and is then no longer actuated but biased.

20 Claims, 14 Drawing Sheets

(56) References Cited

U.S. PATENT DOCUMENTS

| | | | | | |
|---|---|---|---|---|---|
| 4,295,676 | A | | 10/1981 | Smith | |
| 4,343,500 | A | | 8/1982 | Steiner | |
| 4,462,623 | A | | 7/1984 | Grant | |
| 4,493,501 | A | | 1/1985 | Abel | |
| 4,526,412 | A | | 7/1985 | Gist | |
| 4,601,502 | A | | 7/1986 | Van Dyke | |
| 4,686,740 | A | * | 8/1987 | Ishii | 16/85 |
| 4,823,432 | A | * | 4/1989 | Jan | 16/86 A |
| 4,971,374 | A | | 11/1990 | Lovell | |
| 5,018,241 | A | | 5/1991 | Baines | |
| 5,120,093 | A | | 6/1992 | Carney | |
| 5,228,733 | A | | 7/1993 | Winters | |
| 5,593,194 | A | * | 1/1997 | Liau | 292/340 |
| 5,653,487 | A | * | 8/1997 | Proni | 292/288 |
| 5,983,680 | A | * | 11/1999 | Del Nin | 70/93 |
| 6,102,452 | A | * | 8/2000 | Liau | 292/175 |
| 6,336,245 | B1 | * | 1/2002 | Sakakibara | 16/82 |
| 6,467,125 | B1 | | 10/2002 | Johnson | |
| 6,572,160 | B2 | * | 6/2003 | Bunting | 292/342 |
| 7,013,687 | B2 | | 3/2006 | Shedd | |
| 7,367,597 | B2 | * | 5/2008 | Rechberg | 292/304 |
| 8,539,641 | B2 | | 9/2013 | Bartholomew | |
| 2007/0245518 | A1 | * | 10/2007 | Blair | 16/85 |
| 2009/0307869 | A1 | * | 12/2009 | Salice | 16/85 |
| 2011/0232029 | A1 | | 9/2011 | Hartgens | |
| 2013/0239365 | A1 | * | 9/2013 | Payson | 16/85 |

* cited by examiner

DOOR TRAVEL LIMITING DEVICE

FIELD OF THE INVENTION

The present invention relates to improvements in apparatus for the securing of sliding patio doors, and more particularly to apparatus which are capable of primary and/or secondary travel limiting of the door, to alternately restrict or allow access.

BACKGROUND OF THE INVENTION

Patio doors have traditionally been an easy target for a burglar seeking to gain unlawful entry into a home, which typically only required the use of a pry bar and application of a modest amount of force to overcome the locks used therein. Although many homeowners had simply resorted to placing a wooden stick or a strip of wood into the bottom of the track to obstruct sliding movement of the door when not in use, other more elegant devices have been developed. One example is shown by U.S. Pat. No. 4,971,374 to Lovell for a "Home Security Protection Kit."

However, resourceful thieves developed tactics to overcome the use of such devices, as described in U.S. Pat. No. 5,228,733 to Winters, which is for a "Safety Lock for Sliding Glass Doors." Furthermore, these sliding doors were relatively easy to disengage from the track of the frame, even from the outside. This spawned the development of other sliding door related apparatus, such as U.S. Pat. No. 4,526,412 to Gist for "Security Device to Prevent Removal of Sliding Windows and Doors."

Although there have been a number of devices conceived to inhibit the movement of sliding doors, there nevertheless remains a need for an improved device that may serve to desirably limit travel of a sliding patio door to be at a closed position, or alternatively in one or more partially open positions, including a fully opened position, while providing ease of operation for the user that does not sacrifice the security of the door against a forced entry. The present invention provide such travel limiting capabilities and also improved security over the prior art door stops.

OBJECTS OF THE INVENTION

It is an object of the invention to provide a door stop to inhibit travel of a sliding door or window.

It is another object of the invention to provide a door travel limiting device capable of serving as a secondary lock for the door, when the door is in a closed position.

It is a further object of the invention to provide a door travel limiting device capable of inhibiting sliding movement of the door, once the door has been suitably positioned in a partially opened position.

It is another object of the invention to provide a door travel limiting device capable of enhancing the security of a sliding door against a forced entry.

Further objects and advantages of the invention will become apparent from the following description and claims, and from the accompanying drawings.

SUMMARY OF THE INVENTION

A travel limiting device for use with sliding patio doors, or even windows, may include a housing, a stop member, a compression spring, and a flexible member. The stop member may be slidably received by a portion of the housing, and may be slidable in a first sliding direction and in a second sliding direction. The stop member may have first and second ends that respectively extend outwardly from different portions of the housing. The stop member may be biased, through the use of a compression spring, a tension spring, or even a suitably configured leaf spring, to slide in the first sliding direction, to cause a portion of the stop member proximate to its second end to normally be retracted into the housing. Extreme sliding positions of the stop member relative to the housing may be limited by a single protrusion or two different protrusions on the stop member, which may engage a corresponding feature or features of the housing.

A flexible member may be formed integral with, or may be secured to, the stop member, and may protrude therefrom and be configured to selectively engage various portions of a track formed in the housing. A cantilevered free end of the flexible member may engage and follow the contour of the track, and be deflected therein in a first direction, when the stop member is actuated by a user to overcome the biasing and translates from the first position, in which the door is unsecured, to its second position. When the user ceases actuating the stop member, the biasing means causes the stop member to translate in the opposite direction, and the flexible member follows another portion of the track, which directs it to return at least part of the way to its un-deflected position, and be directed into a recess. The free end of the flexible member engages the recess, which prevents the biasing from accomplishing any further travel of the flexible member and stop member, thus the stop member is thereby releasably held at an intermediate travel position being between its first and second positions.

The travel limiting device may be fixedly secured to the sliding door, using any suitable attachment means, including, but not limited to, an epoxy adhesive, a welding process, mechanical fasteners through holes in a flange of the housing, etc. Moreover, the housing may even be integrally formed with the frame of the sliding door.

A keeper may be secured to the master frame within which the sliding door travels, and may be positioned and secured proximate to the travel limiting device. The keeper may have one or more openings in a flange that protrudes away from the master frame. The openings may be formed to match the cross-sectional shape used for the stop member—a cross-sectional shape which may include, but is not limited to, a rectangular shape, circular shape, etc. One such opening may be positioned on the flange of the keeper, so that when it is engaged by the stop member, it may maintain the sliding door in the closed position, and may thus serve as a secondary lock. One or more additional such openings positioned on the flange at a distance from the first opening may be used to limit travel of the sliding door while it is opened only slightly to permit air to circulate therethrough. The positioning and fixedly securing of the keeper to the master frame of the sliding door, and the engagement therewith by the stop member of the travel limiting device, serves to further protect against a forced entry by an intruder using a pry bar in attempting to dislodge the door from its track.

DETAILED DESCRIPTION OF THE INVENTION

Figure 2:
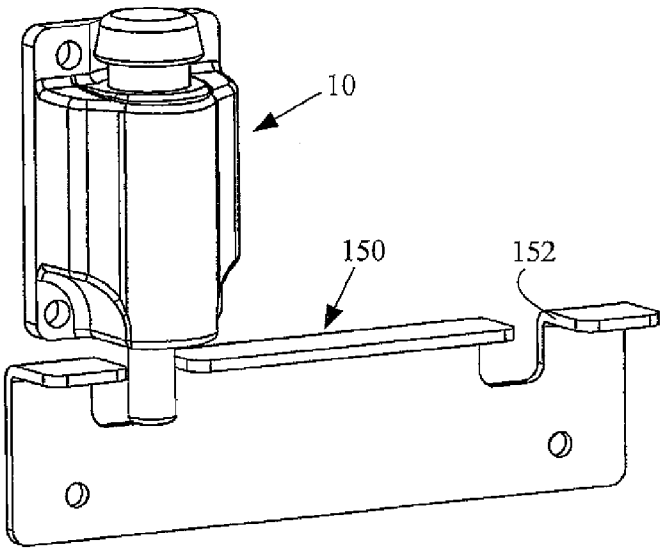
FIG. 2 is the perspective view of FIG. 1, but showing the stop member in a secured position in which it is engaged within a corresponding opening in the keeper, and the door is inhibited from sliding.
Figure 1:
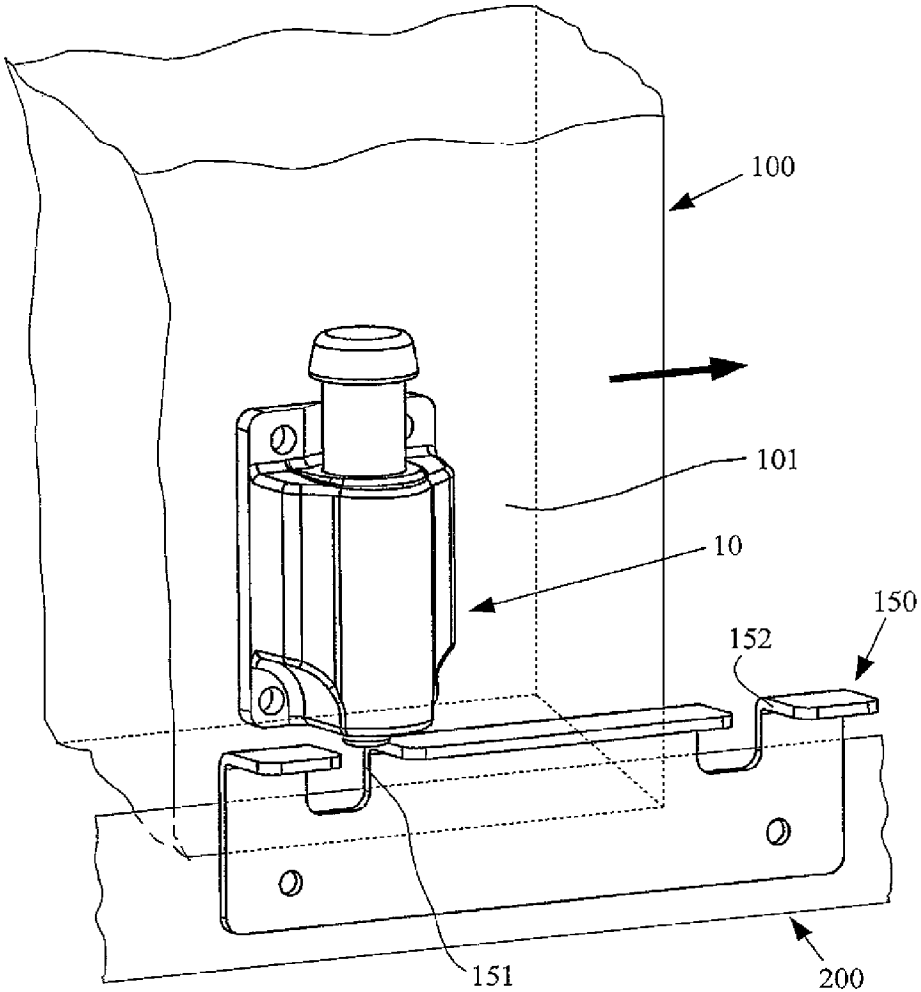
FIG. 1 is a perspective view of the travel limiting device of the present invention after being mounted to a sliding door, and shown with its stop member in the unsecured position relative to the keeper mounted on the master frame, with the door free to slide normally.
Figure 4:
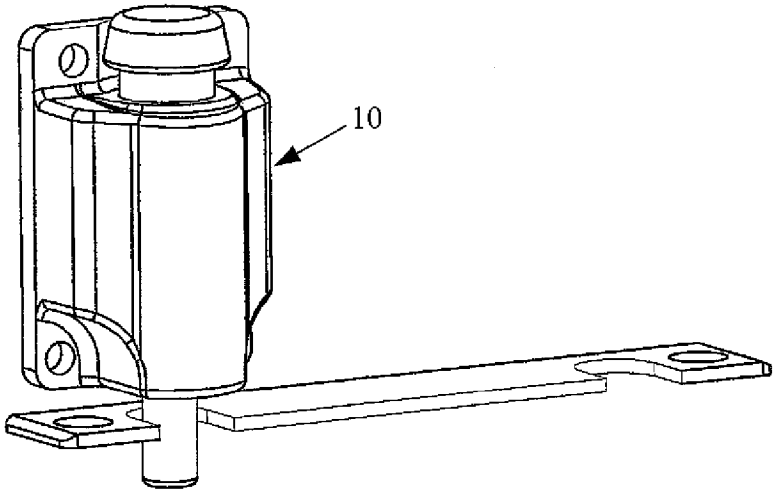
FIG. 4 is a perspective view of the travel limiting device and keeper of FIG. 2, but shown with the stop member in a secured position in which it is engaged within a corresponding opening in the keeper, and the door is inhibited from sliding.
Figure 3:
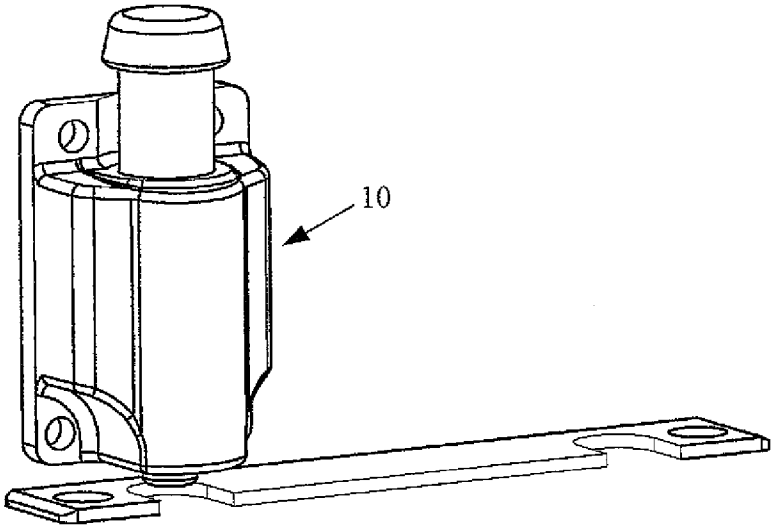
FIG. 3 is a perspective view of the travel limiting device of FIG. 1, but shown with a different style of keeper.
Figure 6:
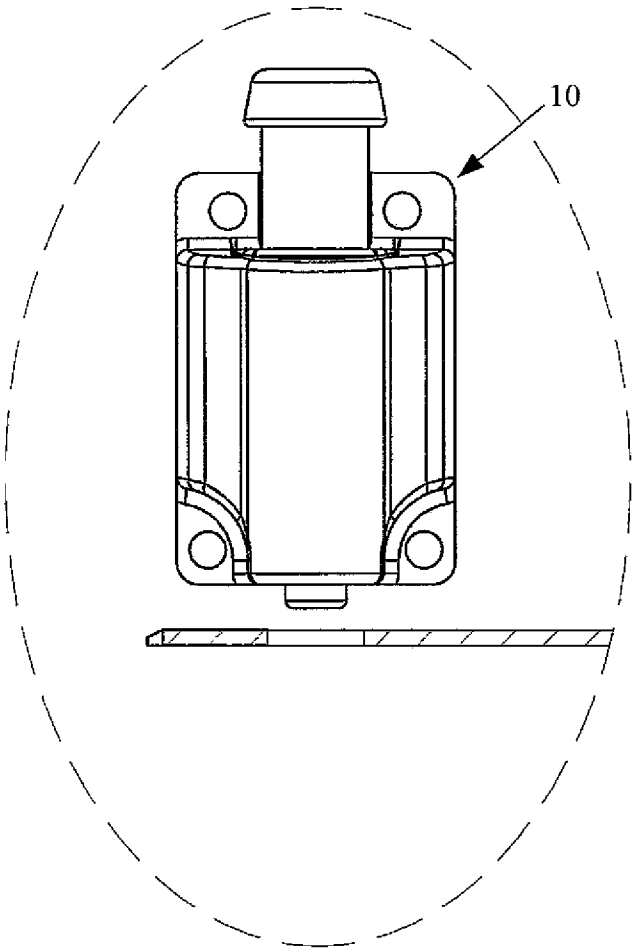
FIG. 6 is a front view of the travel limiting device and keeper of FIG. 3.
Figure 5:
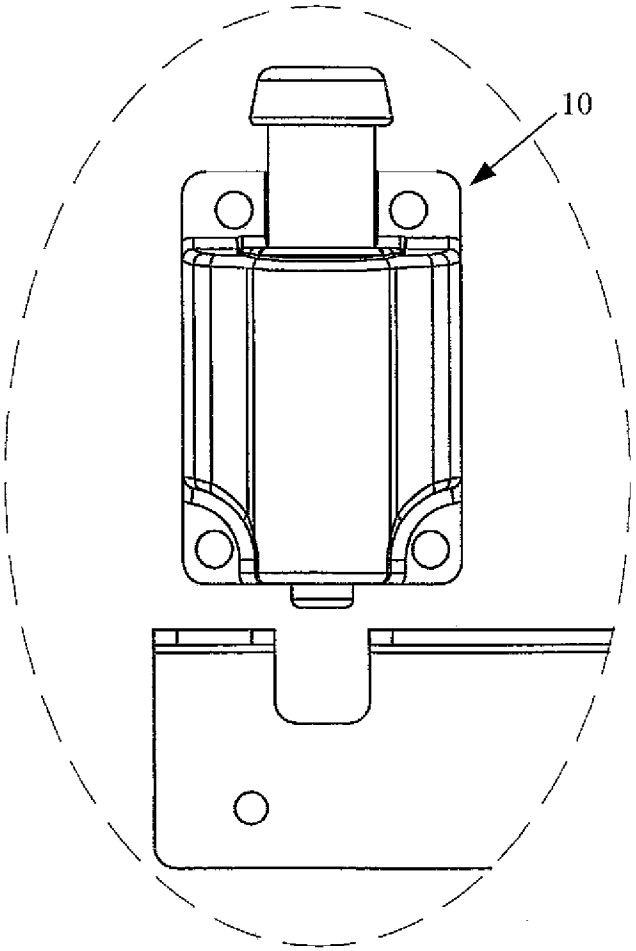
FIG. 5 is a front view of the travel limiting device and keeper of FIG. 1.

FIG. 1 shows a first embodiment of the travel limiting device 10 of the present invention, after being fixedly secured to a sliding door 100. The device of FIG. 1 is shown in the unsecured position so that the door is free to slide open. FIG. 2 shows the device in a first secured position, which may be used to inhibit sliding travel of the door through engagement of a stop member of the device with a corresponding opening in a keeper 150. The keeper 150 may be secured to the master frame 200 in which the door 100 slides. The device 10 and the keeper 150 may each be respectively attached using any suitable attachment means, including, but not limited to, using a welding operation, by using an epoxy adhesive, or using mechanical fasteners (e.g., screws/nuts and bolts), etc. The first opening 151 in the keeper 150 may be positioned along its length, so that when it is engaged by the stopping member of the device 10 that is fixedly secured to the door 100 (FIG. 2), it may serve as a secondary lock for when the door is fully closed. This arrangement of the keeper 150 secured to the master frame 200, and with it being engaged by the stop member of the device 10 may additionally serve to further enhance the overall security of the sliding door, to be able to better withstand forced entry by an intruder making use of a pry bar to attempt to dislodge the door from the track of the master frame. For that reason—providing additional security against the forced entry—a pair of devices 10 may be respectively installed upon a lower frame portion (e.g., lower rail/stile juncture) 101 of the sliding door 100, and on an upper frame portion, where each device may engage a corresponding keeper that is respectively secured to an upper portion of the master frame and to a lower portion of the master frame.

The second opening 152 in the keeper 150 may be positioned so that it may be engaged by the device 10 when the door has been slid open slightly, to allow fresh air to circulate through the opening between the door and its frame. This would not pose a serious impediment to an enterprising thief seeking to gain entry through that door; however, it may serve to prevent a small child from egressing therethrough, by limiting the opening created through sliding travel of the door to be fairly narrow. For that reason, there may be several other openings (e.g., a third opening and a fourth opening, etc.) in the keeper 150, to permit the homeowner to utilize the stopping member of the device 10 with a suitably positioned keeper opening that may result in a sufficiently/suitably sized opening between the sliding door and the master frame.

Although young children are very creative and may at some point learn to defeat the device 10 by operating its stopping member, in order to gain unobstructed access through the opening creating between the sliding of the master frame, this creativity may be thwarted through the use of the device 10 positioned at the top of the door frame to thereat engage a keeper secured to the upper portion of the master frame.

Figure 7A:
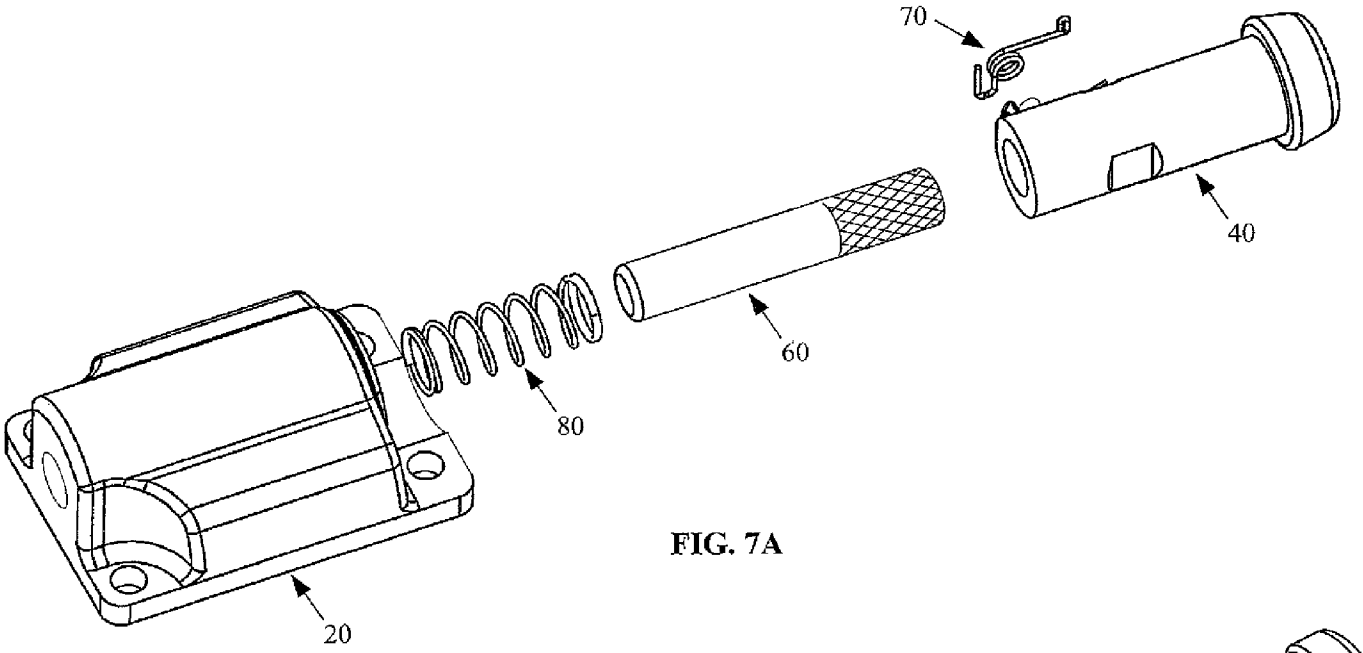
FIG. 7A is an exploded view of the component parts used to make one embodiment of the travel limiting device of FIG. 1.
Figure 7B:
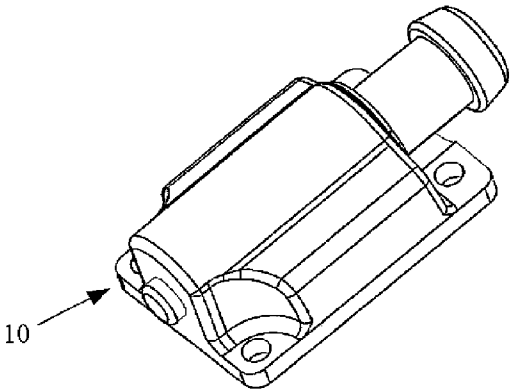
FIG. 7B is a perspective view of the component parts of FIG. 7A, after being assembled.

FIG. 7A shows an exploded view of one embodiment of the component parts that may be used to create the travel limiting device 10. The parts may include a housing 20, a button member 40, a locking pole 60, flexible member 70, and a compression spring 80.

Button 40 is shown in detail in FIGS. 20-23, and may be formed of any suitable material, including, but not limited to, plastic, metal, composite materials, etc. The body of button 40 may be formed with any suitable cross-sectional shape, including a rectangular cross-section, but to be exemplary, it is shown throughout the figures presented herein with a circular cross-section, so that the button has a substantially cylindrical body 43 with a first end 41 and a second end 42. A portion of the cylindrical body 43 may have another protrusion 44 extending laterally therefrom, and may be formed integrally with the cylinder 43, or may be fixedly secured thereto. Protrusion 44 may also be used to limit sliding travel of the button 40 in a first direction, as discussed hereinafter. The first end 41 of the cylindrical shaft 43 may have a head 48 protruding therefrom, which may be formed to be slightly larger than the cylinder 43 of button 40, to better accommodate actuation of the device by a user's hand or foot. The protruding head 48 may also serve to limit sliding travel of the button in a second direction, which is also discussed hereinafter with respect to operation of the device.

Figure 19A:
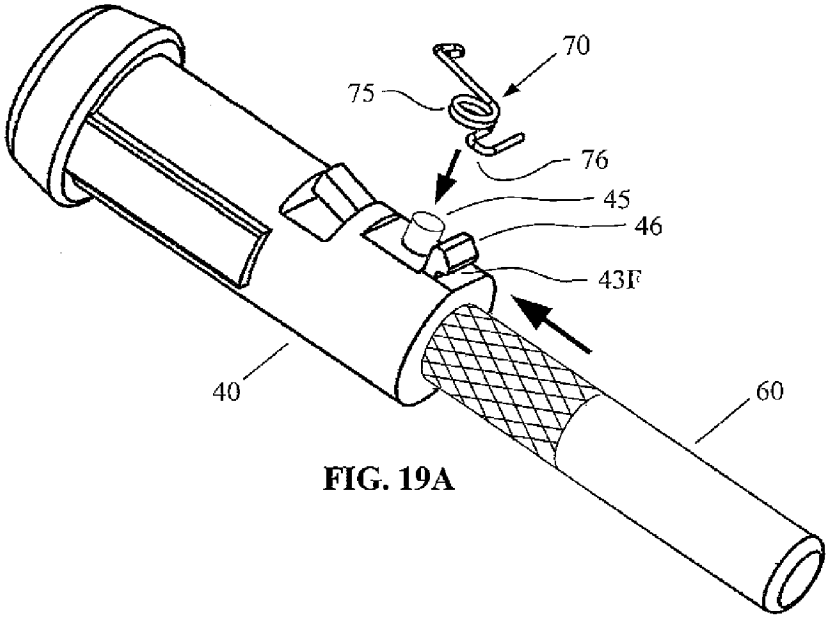
FIG. 19A is an exploded view of the button member and locking pole used to form a second embodiment of the stopping member of the present invention.
Figure 24:
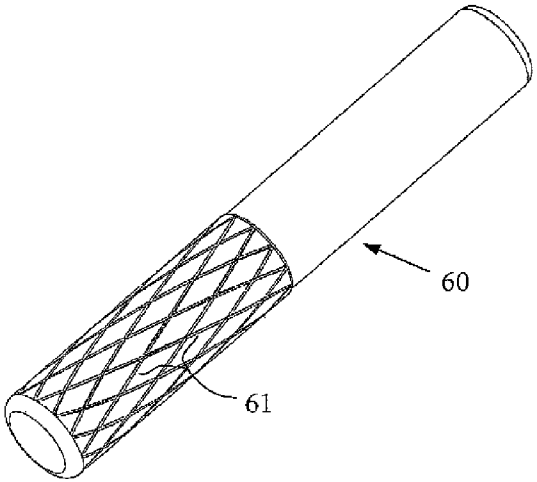
FIG. 24 is a perspective view of the locking pole of FIG. 19A.
Figure 26:
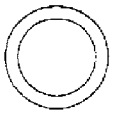
FIG. 26 is an end view of the locking pole of FIG. 24.
Figure 25:
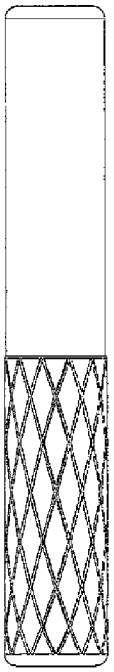
FIG. 25 is a side view of the locking pole of FIG. 24.
Figure 27:
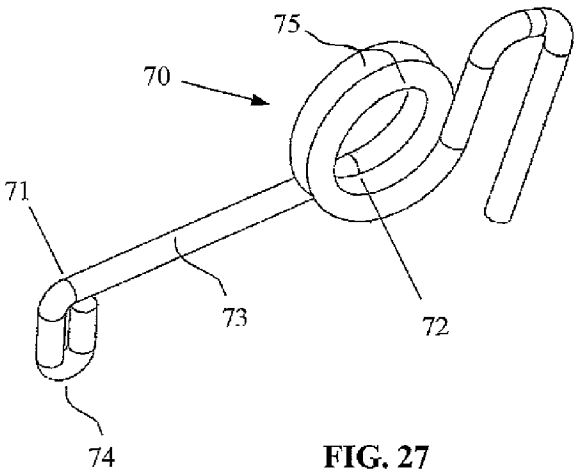
FIG. 27 is a perspective view of a first embodiment of the flexible member of the present invention.
Figure 30:
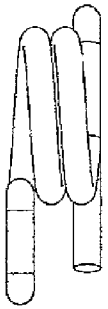
FIG. 30 is an end view of the flexible member of FIG. 27.
Figure 29:
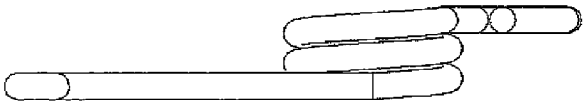
FIG. 29 is a top view of the flexible member of FIG. 27.
Figure 28:
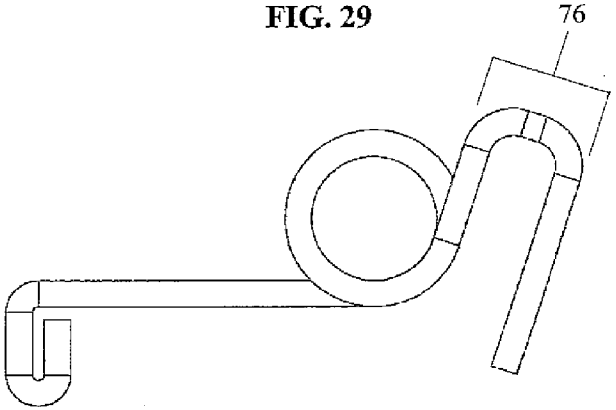
FIG. 28 is a side view of the flexible member of FIG. 27.
Figure 31:
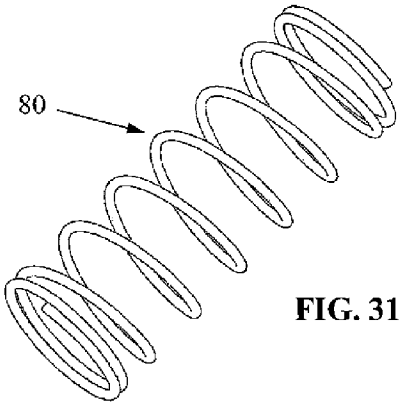
FIG. 31 is a perspective view of a first embodiment of the biasing means of the present invention, being a compression spring.
Figure 33:
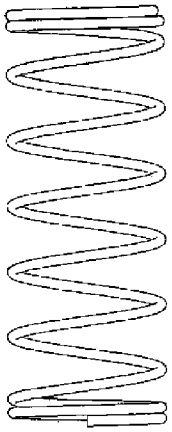
FIG. 33 is a front view of the compression spring of FIG. 31.
Figure 34:
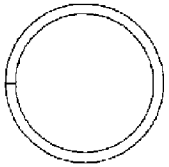
FIG. 34 is an end view of the compression spring of FIG. 31.
Figure 32:
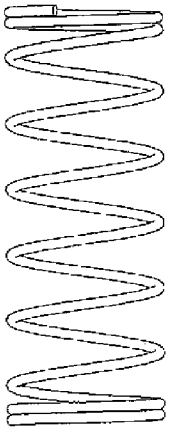
FIG. 32 is a side view of the compression spring of FIG. 31.

A hole 47 having an axis generally concentric with the axis of cylinder 43 may be formed in button 40 beginning from the second end 42, and extending either completely through the button or only to a depth terminating between first end 41 and second end 42. Hole 47 of button 40 may receive the locking pole 60 therein. Locking pole 60, which is shown in detail within FIGS. 24-26, may also be formed using any suitable cross-sectional shape (e.g., square, rectangular, circular, hexagonal, etc.); however, to be exemplary, it is shown herein having been formed with a circular cross-section so that the locking pole is generally a cylindrical member. Part of the outer cylindrical surface of the locking pole 60 may have knurling 61 formed thereon, which may be used to enhance receiving of the locking pole within hole 47 in a press fit, as shown in FIG. 19A. Alternatively, or in addition to the knurling 61, adhesive may be used to retain the locking pole within the hole 47. Adhesive may be utilized where a clearance fit for hole 47 is utilized, in the absence of knurling. The locking pole may be constructed using the same material that is used for button 40, or it may be formed using a material that is better suited for engagement with the keeper 150.

Button 40 may also include a post 45 that may protrude from the cylinder 43. The post 45 may be used to receive a portion of the flexible member 70, which is shown in detail in FIGS. 27-30. The flexible member 70 may include an elongated portion 73 that has a first end 71 and a second end 72. The first end 71 of the elongated portion 73 may transition into an engagement portion of the flexible member, and may be formed at an angle with respect to the elongated portion 73. The engagement portion 74 may terminate in a rounded end, or it may instead be bent at an obtuse angle, which may be 180 degrees, to form a rounded engagement surface. The second end 72 of the elongated portion 73 may transition into a series of helical turns 75, which may be sized to fit upon the post 45 of the button 40.

Figure 19B:
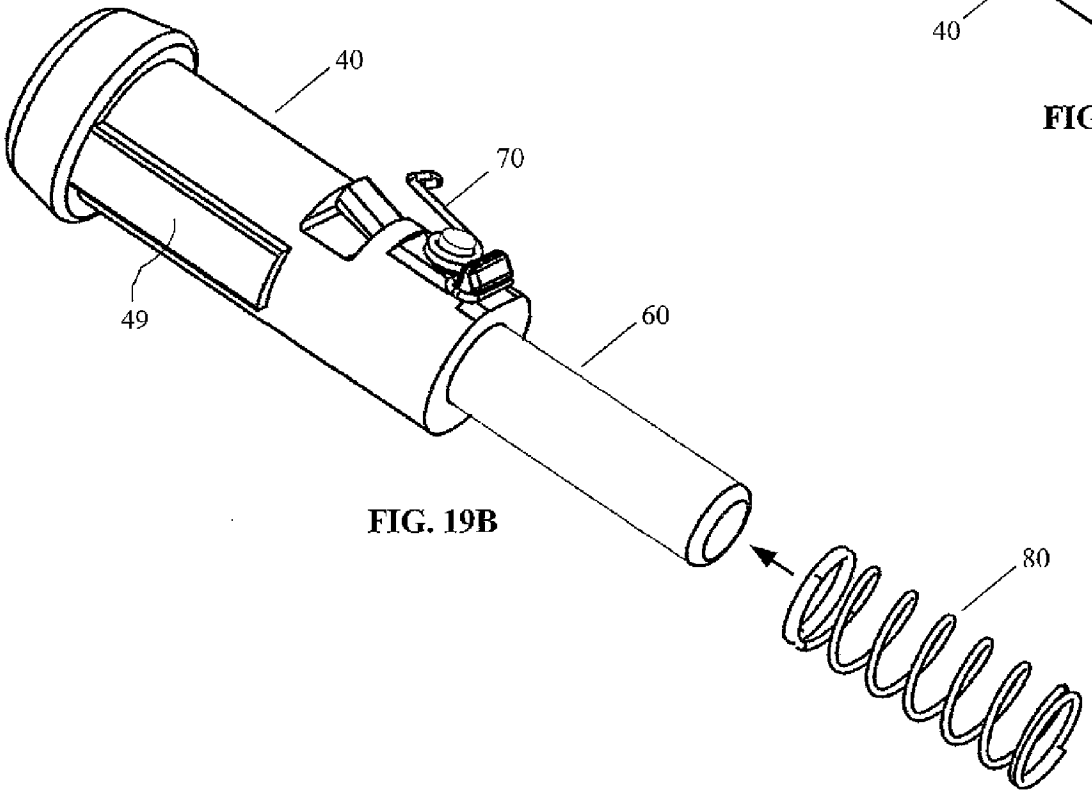
FIG. 19B shows the component parts of the stopping member of FIG. 19A after being assembled, and with the flexible member secured thereon, and the locking pole ready to receive a compression spring thereon.
Figure 20:
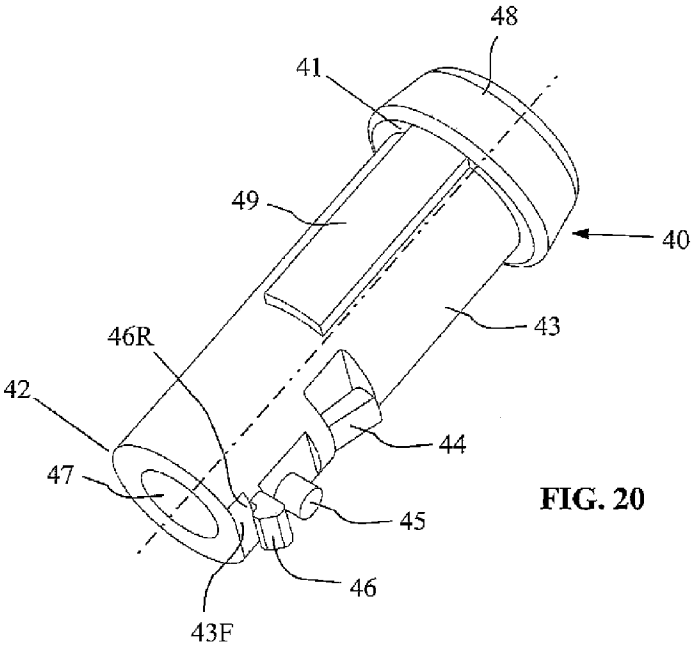
FIG. 20 is a perspective view of the button member of FIG. 19A.
Figure 22:
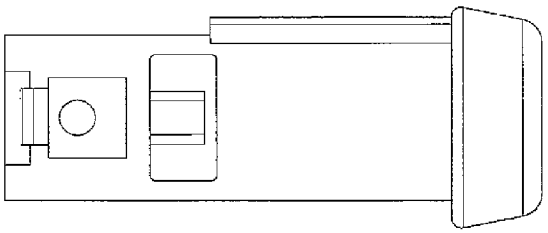
FIG. 22 is a top view of the button member of FIG. 20.

To be able to more positively secure the flexible member 70 to the button 40, the series of turns 75 may transition into a hook 76, which may be received within a recess 46R formed by a protrusion 46 and a flat portion 43F formed on the cylinder 43 of the button 40 (FIG. 20). The flexible member 70 and the button 40 are shown within FIG. 19A prior to mounting of the flexible member, and is shown within FIG. 19B after being mounted thereon.

Figure 18:
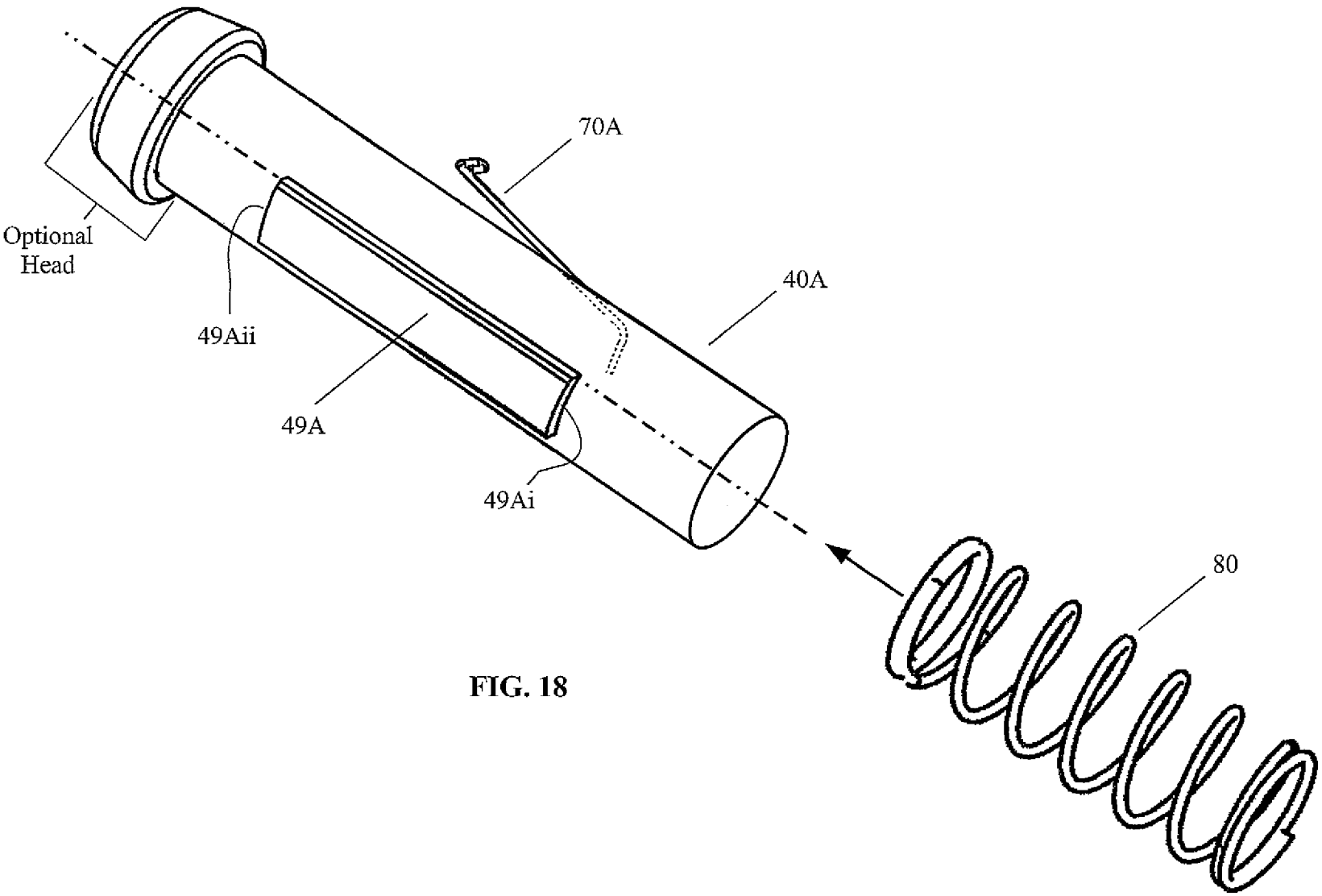
FIG. 18 is a perspective view of one embodiment of a stopping member of the present invention.

An alternate embodiment for the flexible member may be utilized, and is shown within FIG. 18, in which the flexible member 70A may be formed integral with the button, or be fixedly secured thereto, to cantilever directly therefrom. FIG. 18 also shows an alternate embodiment for the forming of the button and locking pole combination, where the two individual parts have been combined and replaced by a single part—stopping member 40A. Stopping member 40A may have an elongated protrusion 49A that is oriented in the axial direction of the cylindrical stopping member, and may be formed integral therewith, or may instead be fixedly secured to the cylinder. A first end 49$A_i$ of the elongated protrusion 49A may be used to limit travel of the stopping member 40A in a first axial direction, while a second end 49$A_{ii}$ of the elongated protrusion 49A may be used to limit travel of the stopping member in a second axial direction, which may eliminate the need for the protruding head that is used on button 40.

The stopping member for device 10 is intended to slide within the housing 20 to engage keeper 150, and so where the cross-sectional shape of the stopping member is square or rectangular, or another polygonal or irregular shape, there is no concern about rotation of the stopping member, which may adversely affect operation of the flexible member, when the stopping member translates within a correspondingly shaped ("keyed") opening in the housing. With the use of a circular cross-section to form a cylindrical shape for the stopping member, anti-rotation of the member within a corresponding cylindrical opening in the housing may be prevented by the elongated protrusion 49A engaging a corresponding opening in the housing 20, in a similar key/keyway arrangement. A similar elongated protrusion 49 may also be used on the cylindrical body 43 of button 40 for the same purpose.

Figure 14:
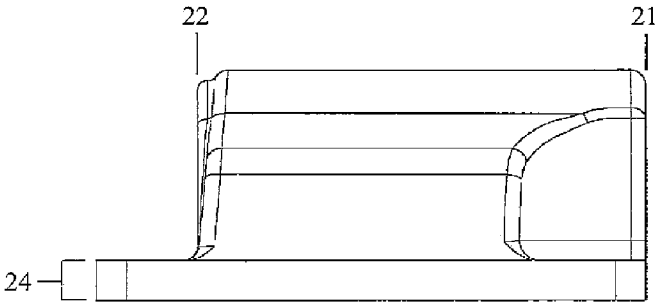
FIG. 14 is a side view of the housing of FIG. 12.
Figure 12:
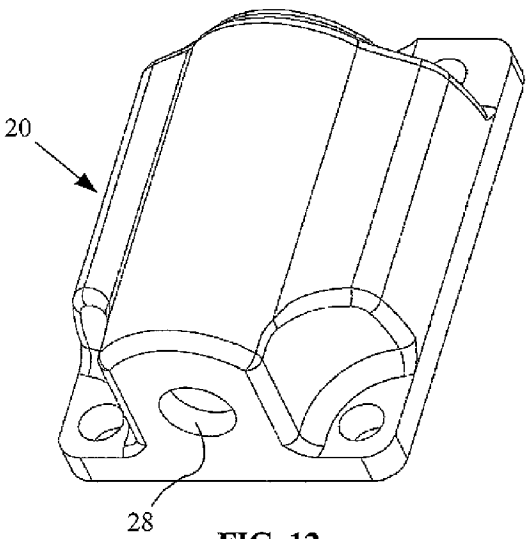
FIG. 12 is a perspective view of the exterior of the housing of the travel limiting device of FIG. 7B.
Figure 13:
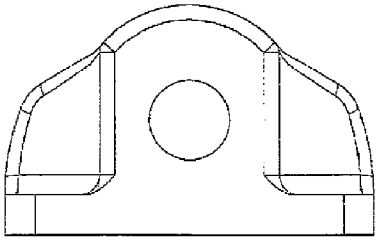
FIG. 13 is an end view of the housing of FIG. 12.
Figure 15:
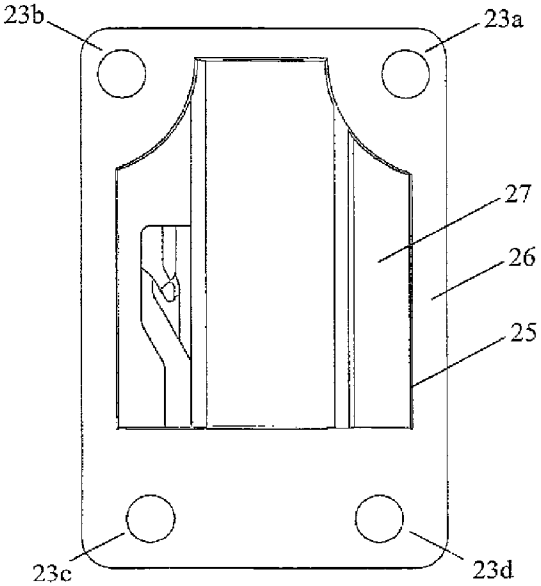
FIG. 15 is a rear view of the housing of FIG. 12.

The housing may be formed into many different shapes. An exemplary housing 20 is illustrated in detail within FIGS. 12-15, and may generally have a first end 21 and a second end 22. As stated hereinabove, housing 20 may be secured to the door 100 by using a welding process, or using adhesive, or using mechanical fasteners. Where one or more mechanical fasteners are to be used for mounting the housing, these fasteners may be received through a hole or a pattern of holes (e.g., 23*a*/23*b*/23*c*/23*d*) in flange 24 of the housing. The flange may, but need not necessarily, extend beyond the ends 21/22 of the housing, depending upon the location chosen for the pattern of mounting holes. The flange 24 extends beyond the second end 22 of the housing shown in FIG. 14, as the holes 23*a* and 23*b* were disposed above the cavity, rather than being disposed to the side of the cavity.

Figure 17:
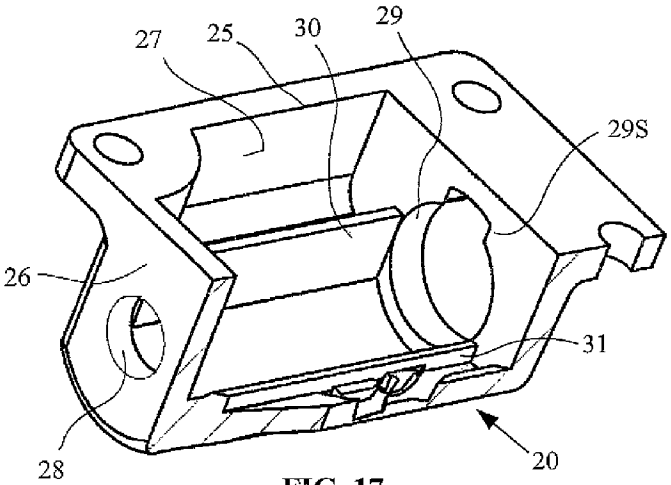
FIG. 17 is a reverse perspective section view of the housing of FIG. 16, showing the opposite side of the track regions therein.

An opening 25 in the exterior surface 26 of the housing may create a cavity defined by an interior surface 27. The second end 22 of the housing 20 may have an orifice 28 that penetrates from the exterior surface through the interior surface of the cavity. Orifice 28 may be formed to match the cross-sectional shape of the stop member. Housing 20 is illustrated within the drawing figures to be configured to receive the combination locking pole 60 and button 40, and therefore orifice 28 is shown therein as a cylindrical hole, which may have a diameter sized to provide a clearance fit with the outer diameter of locking pole 60. The first end 21 of the housing may have an orifice 29 (FIG. 17) therein that penetrates from the exterior surface through the interior surface of the cavity. Orifice 29 may also be formed to match the cross-sectional shape of the stop member, and since the housing is illustrated within the drawing figures to be configured to receive the combination locking pole 60 and button 40, orifice 29 is shown therein as a cylindrical hole, which may have a diameter sized to provide a clearance fit with the outer diameter of the locking pole. FIG. 17 also shows the slotted opening 29S cut adjacent to, and interconnecting with, the orifice 29 to form a keyway that is shaped to receive the elongated anti-rotation protrusion 49 of button 40.

The assembled combination of button 40 and locking pole 60 shown in FIG. 19B may be received through the keyway formed by orifice 29 and slotted opening 29S, with the free end of the locking pole entering first through the keyway. As the end of the locking pole 60 clears the keyway and initially enters the cavity of the housing 20, the compression spring 80 may be inserted into the cavity through opening 25, so that it may be received upon the end of the locking pole. The assembled combination of button 40 and locking pole 60 may be further advanced through the keyway, with its orientation being particularly clocked such that post 45 and then protrusion 46, each of which extends away from the outer diameter of the button cylinder, may pass through the slotted opening 29S of the keyway. Once those two features have entered the cavity, the clocking of the combination may be reoriented (if the anti-rotation protrusion 49 of button 40 is not formed in-line with the post 45 and 46) so that the anti-rotation protrusion 49 may next enter the slotted opening 29S of the keyway. This adjustment to the clocking may also operate to cause the engagement portion 74 of flexible member 70 to rotate into engagement with a track formed in the interior surface of the housing cavity, as discussed hereinafter. The free end of the locking pole may be received through, and exit out from, the orifice 28 of housing 20. (Note that other assembly sequences for construction of device 10 are possible, and the one described herein is merely meant to be an exemplary sequence).

Figure 23:
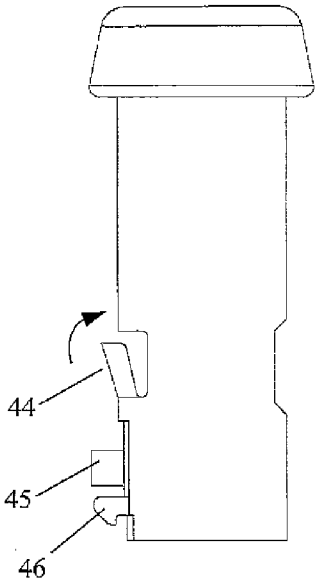
FIG. 23 is a side view of the button member of FIG. 20.
Figure 21:
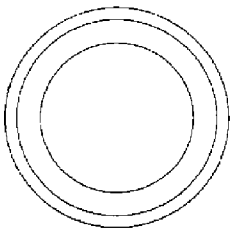
FIG. 21 is an end view of the button member of FIG. 20.

The combination of button 40 and locking pole 60 may be prevented from backing out, by the use of protrusion 44 on the button 40. As seen in FIG. 23, the protrusion may be formed to extend/cantilever, at an angle, out from a recess in the cylinder 43 of the button 40. So, as the combination is inserted in through the keyway in the housing formed by orifice 29 and slotted opening 29S, the protrusion is forced to deflect inwardly through contact of the angled side of the protrusion 44 with the housing, as indicated by the arrow in FIG. 23. Once the combination is properly seated in the housing cavity, the protrusion clears the housing wall and returns to its undeflected position, from which it prevents removal of the combination from the housing 20. The assembled device 10 is shown in FIG. 8A.

Figure 16:
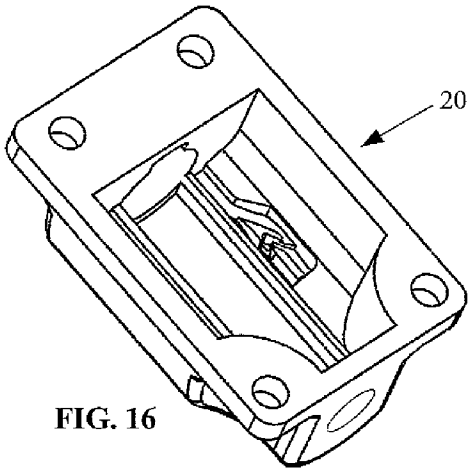
FIG. 16 is a perspective view of the interior cavity of the housing of FIG. 7B.
Figure 16A:
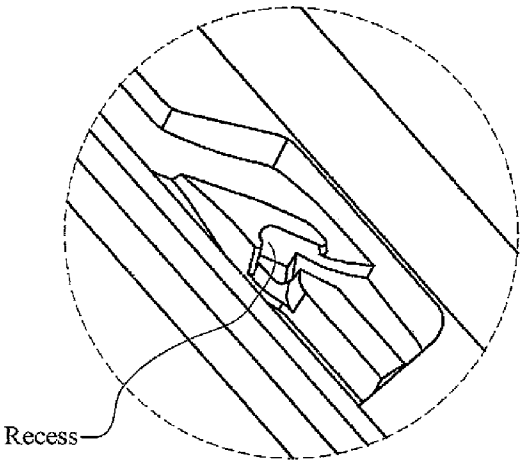
FIG. 16A is an enlarged detail view of the housing cavity showing the track regions on a portion of the interior wall of the housing of FIG. 16.

The track formed in the interior surface 27 of the housing cavity is shown within the perspective view of FIG. 16, as well as the enlarged detail view taken therefrom and shown in FIG. 16A. The track is also shown within the reverse perspective section view of the housing in FIG. 16, and in the enlarged detail cut-away view of FIG. 17A. The track may be formed by various topographical changes to a portion of the interior surface 27 of the housing, to form discretely different regions or portions of the track's surface features that may be sequentially encountered by the engagement portion 74 of flexible member 70, as it is driven by translation of the button 40 or the stop member. Stiffeners 30 and 31 (FIG. 17) may be formed within the housing cavity to provide additional structural integrity, and may also serve to assure sliding movement of the stop member in a straight line, to enable proper sequenced movements of the engagement portion 74 of flexible member 70 with respect to the track.

Figure 9:
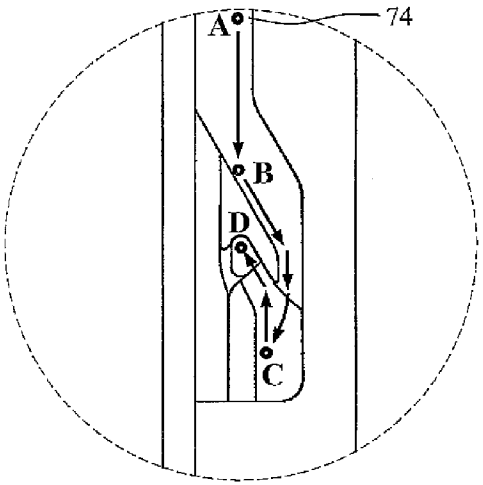
FIG. 9 is an enlarged view of the housing track, showing progressive movement of the end of the flexible member between its positions corresponding to positions A, B, C, and D of the stop member.

FIG. 9 shows a top view of the track features formed on the interior surface 27 in the cavity of housing 20, and with certain key positional movements of the engagement portion 74 of flexible member 70 also denoted therein. When the combination of button 40 and locking pole 60 is in the door unsecured position, shown by FIG. 1 and FIG. 8A, the engagement portion 74 of flexible member 70 may engage the track or be slightly displaced therefrom, which is denoted at position "A."

Figure 8C:
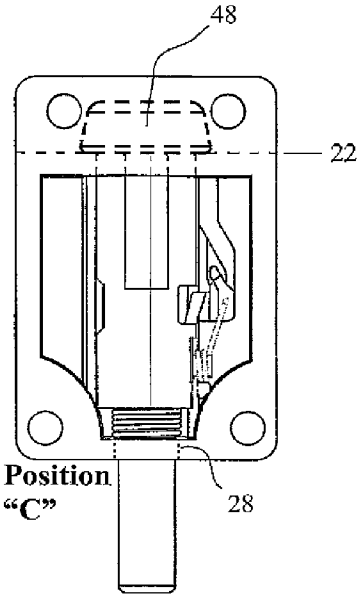
FIG. 8C is the rear view of FIG. 8B, but showing the sliding member having been actuated further to reach a second (downward) travel limited position, denoted as position "C," and the free end of the flexible member has moved to be clear of the first region of the housing track and subsequently contacts a second region of the housing track.
Figure 8D:
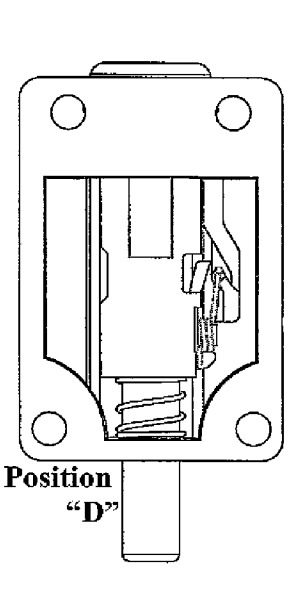
FIG. 8D is the rear view of FIG. 8C, but showing the sliding member no longer being actuated, and the biasing means having caused reverse-translation of the stop member, and with the second region on the housing track having directed the flexible member to return at least part of the way to its un-deflected position, and having directed its end into a recess, to releasably retain the stop member at a position "C," being intermediate between position A and position B (door secured position).
Figure 8B:
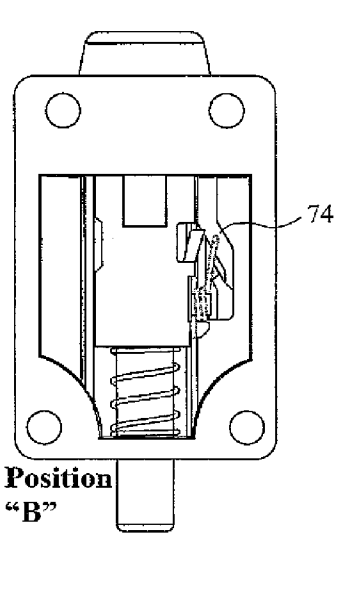
FIG. 8B is the rear view of FIG. 8A, but showing the sliding member having been actuated to translate until the free end of the flexible member contacts a first region of the housing track at position "B," and is thereby deflected laterally in a first direction due to its contact with the track.
Figure 8A:
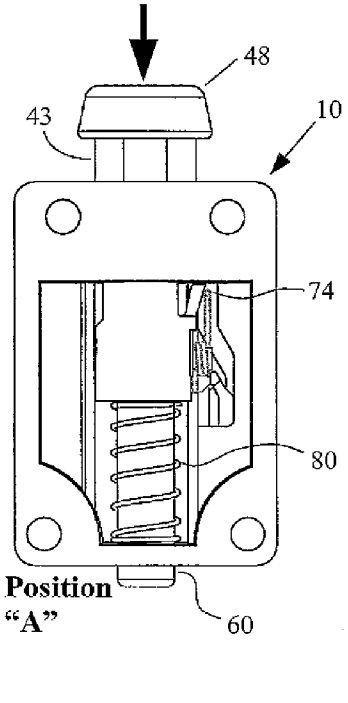
FIG. 8A is a rear view of the travel limiting device of FIG. 7B, showing the sliding member within the cavity of the housing occupying a first (upward) travel limited position (unsecured door position), and showing the free end of the flexible member, which extends from the stop member, being at a first position (position "A") within a housing track therein.
Figure 17A:
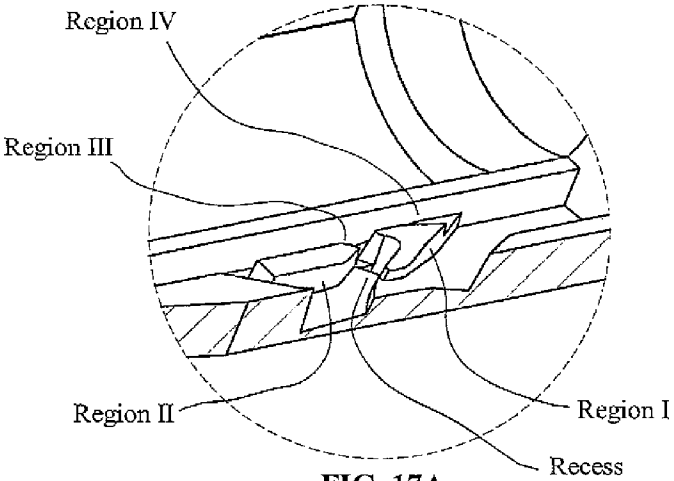
FIG. 17A is an enlarged detail view of the track regions illustrated within FIG. 17.

As the user of device 10 applies a force to the stop member or to the head 48 of button 40, shown by the downward arrow in FIG. 8A, the combination of button 40 and locking pole 60 (the stop member) translates downwardly, and the engagement portion 74 of flexible member 70 similarly translates downwardly until the device reaches position "B." At position "B" for the device, the free end of the locking pole 60 (the stop member) protrudes even farther outward from the orifice 28, and the engagement portion 74 of flexible member 70 has now contacted and been engaged by a first region of the track (FIG. 17A). Thereafter, continued application of the force by the user to cause further downward translation of the button results in the portion of the flexible member 70 that is fixedly secured thereto to also translate; however, the cantilevered engagement portion 74 of the flexible member is caused to deflect in a first, outward, direction by its contact with the first track region, and is thereby directed to avoid a recess during the downward translation. As the downward translation is nearly complete, which is defined by the travel limit imposed by the protrusion 49A of the stop member of FIG. 18, or by the head 48 contacting the second end 22 of housing 20 for the combination of button 40 and locking pole 60 (FIG. 8C), the engagement portion 74 of flexible member 70 moves clear of the first track region, and is engaged by a second track region. Complete downward travel is shown by position "C" in FIG. 8C.

Once the user ceases to apply the downward force, the compression spring 80, which has been compressed by that downward translation and has stored elastic strain energy, now works to bias the combination of button 40 and locking pole 60 (i.e., the stop member) to translate upwardly. During this biased upward translation, the second track region serves to guide and direct the engagement portion 74 of flexible member 70 toward the recess. The engagement portion 74 is then nested within the recess at position "D," and the stop member of device 10 is thereby inhibited from being biased any further, and is maintained at an intermediate position between the door unsecured position of FIG. 8A, and the full downwardly translated position of FIG. 8C. The position of the locking pole 60 at position "D" for device 10 constitutes the door secured position that is shown in FIG. 8D and FIG. 2.

Figures 10A, 10B, 10C, 11:
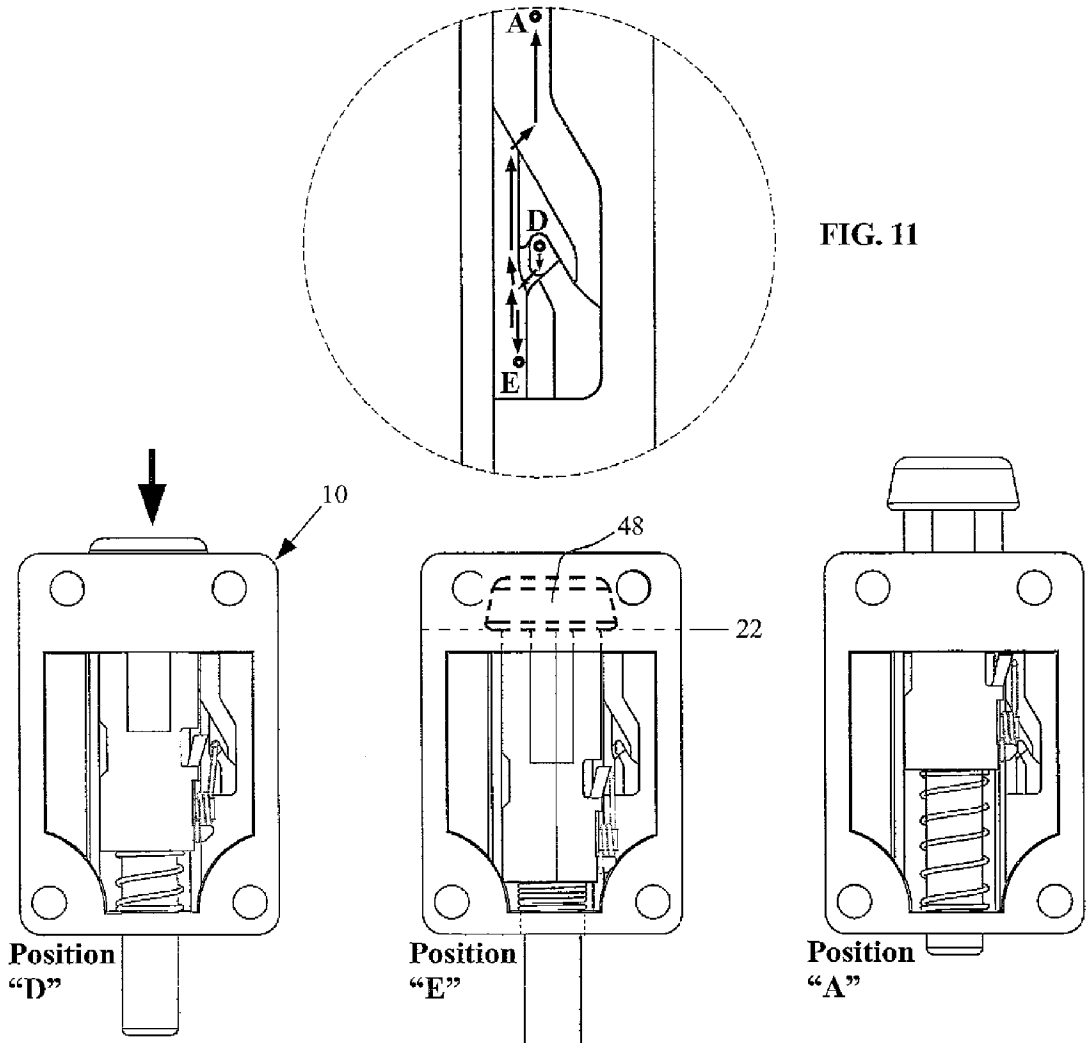
FIG. 10A is the same as FIG. 8D, illustrating position "D."
FIG. 10B is the rear view of FIG. 10A, but showing the stop member having again been actuated to its second (downward) travel limited position, denoted as position "E," since the free end of the flexible member had been caused to deflect in a second direction due to its contact with a third region of the housing track.
FIG. 10C is the same as FIG. 8A, illustrating position "A,"' after the stop member of FIG. 10B was no longer being actuated, and the free end of the flexible member had been directed by a fourth region of the housing track to avoid the recess and return to its initial position within the track.
FIG. 11 is an enlarged view of the housing track, showing progressive movement of the end of the flexible member between its positions corresponding to positions D, E, and A of the stop member.

Once the user desires to subsequently move the position of the door, the device again needs to be actuated by the application of a downward force to the head 48 of button 40, which is shown by the downward arrow in FIG. 10A. The combination of button 40 and locking pole 60 (the stop member) again translates downwardly until again reaching the travel limit imposed by the protrusion 49A of the stop member of FIG. 18, or by the head 48 contacting the second end 22 of housing 20 for the combination of button 40 and locking pole 60 (FIG. 8C). Complete downward travel is shown by position "E" in FIG. 10B. However, position "E" for device 10 is different than position "C," because as the engagement portion 74 of flexible member 70 exits the recess and is caused to translate downward, it now contacts a third track region, and is engaged by the third track region and caused to deflect in a second direction. The second direction may be opposite from the first direction.

As the stop member approaches the downward travel limit, the engagement portion 74 of flexible member 70 is caused to engage with a fourth track portion. Once the user again ceases to apply the downward force, the compression spring 80 once again works to bias the combination of button 40 and locking pole 60 (i.e., the stop member) to translate upwardly. During this biased upward translation from position "E," the fourth track region serves to guide and direct the engagement portion 74 of flexible member 70 back toward position "A," which it reaches when the stop member reaches the upward travel limit.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. A door travel limiting device comprising:

a housing, a stop member slidably received with respect to said housing to be slidable in a first sliding direction and a second sliding direction, with a first end of said stop member configured to extend out from a first portion of said housing, and a second end of said stop member configured to extend out from a second portion of said housing;

means for biasing configured to bias said stop member to slide in said first direction;

means for limiting travel of said stop member in said first sliding direction to be at a first position, and in said second sliding direction to be at a second position; and a flexible member, said flexible member configured to extend from said stop member, and configured to selectively engage different portions of a track on said housing to retain said second end of said stop member at an intermediate travel limited position between said first and second stop member positions, when said stop member is initially actuated by a force to slide from said first position to said second position, and is then no longer actuated but instead only biased by said means for biasing.

2. The door travel limiting device according to claim 1, wherein said selective engagement of said flexible member with said housing track for said stop member to travel to said intermediate position comprises:

a first portion of said track configured to deflect said flexible member in a first direction when said stop member is actuated to slide from said first position to said second position; and a second portion of said track configured to direct said flexible member to engage a recess to limit travel of said stop member to said intermediate position, when said stop member no longer actuated but biased by said means for biasing.

3. The door travel limiting device according to claim 2, further comprising:

a third portion of said track configured to deflect said flexible member in a second direction, when said stop member is actuated to slide from said intermediate position to said second position; and a fourth portion of said track configured to direct said flexible member to avoid said recess, when said stop member is no longer actuated but biased by said means for biasing to return said stop member to said first position.

4. The door travel limiting device according to claim 1, further comprising an anti-rotation means configured to substantially limit said sliding of said stop member to only translation.

5. The door travel limiting device according to claim 1, wherein at least a portion of said stop member comprises a cylindrical shaft.

6. The door travel limiting device according to claim 1, wherein said housing comprises means for mounting said housing.

7. A door travel limiting device comprising:

a housing, a stop member slidably received with respect to said housing to be slidable in a first sliding direction and a second sliding direction, with a first end of said stop member configured to extend out from a first portion of said housing, and a second end of said stop member configured to extend out from a second portion of said housing;

a compression spring configured to bias said stop member to slide in said first direction;

a first protrusion on said stop member configured to limit travel of said stop member in said first sliding direction to be at a first position;

a second protrusion on said stop member configured to limit travel of said stop member in said second sliding direction to be at a second position; and a flexible member, said flexible member configured to protrude from said stop member, and configured to selectively engage different portions of a track on said housing to retain said second end of said stop member at an intermediate travel limited position between said first and second stop member positions when said stop member is initially actuated by a force to slide from said first position to said second position, and is then no longer actuated but instead only biased by said compression spring.

8. The door travel limiting device according to claim 7, wherein said selective engagement of said flexible member with said housing track for said stop member to travel to said intermediate position comprises:

a first portion of said track configured to deflect said flexible member in a first direction when said stop member is actuated to slide from said first position to said second position; and a second portion of said track configured to direct said flexible member to engage a recess to limit travel of said stop member to said intermediate position, when said stop member no longer actuated but biased by said compression spring.

9. The door travel limiting device according to claim 8, further comprising:

a third portion of said track configured to deflect said flexible member in a second direction, when said stop member is actuated to slide from said intermediate position to said second position; and a fourth portion of said track configured to direct said flexible member to avoid said recess, when said stop member is no longer actuated but biased by said compression spring to return said stop member to said first position.

10. The door travel limiting device according to claim 9, further comprising a selectively shaped protrusion on said stop member, and a correspondingly shaped opening on said housing configured to slidably receive said selectively shaped opening of said stop member, to substantially limit said sliding of said stop member to only translation.

11. The door travel limiting device according to claim 10, wherein at least a portion of said stop member comprises a cylindrical shaft.

12. The door travel limiting device according to claim 11, wherein said first protrusion on said stop member comprises a knob.

13. The door travel limiting device according to claim 12, wherein said housing comprises a mounting flange, said mounting flange comprising one or more mounting holes therethrough.

14. A combination door stop and keeper, for use in limiting travel of a sliding patio door to one or more door positions, said door stop comprising:

a housing, a stop member slidably received with respect to said housing to be slidable in a first sliding direction and a second sliding direction, with a first end of said stop member configured to extend out from a first portion of said housing, and a second end of said stop member configured to extend out from a second portion of said housing;

a compression spring configured to bias said stop member to slide in said first direction;

a first protrusion on said stop member configured to limit travel of said stop member in said first sliding direction to be at a first position;

a second protrusion on said stop member configured to limit travel of said stop member in said second sliding direction to be at a second position; and a flexible member, said flexible member configured to protrude from said stop member, and configured to selectively engage different portions of a track on said housing to retain said second end of said stop member at an intermediate travel limited position between said first and second stop member positions when said stop member is actuated by a force to slide from said first position to said second position, and then no longer actuated but biased by said compression spring, said keeper comprising:

a first flange, said first flange comprising one or more holes, for use in securing said keeper to a master frame configured to accommodate sliding of the patio door; and a second flange, said second flange extending from said first flange, said second flange comprising one or more openings each configured to receive said second end of said stop member, when said stop member is in said intermediate position.

15. The door travel limiting device according to claim 14, wherein said selective engagement of said flexible member with said housing track for said stop member to travel to said intermediate position comprises:

a first portion of said track configured to deflect said flexible member in a first direction when said stop member is actuated to slide from said first position to said second position; and a second portion of said track configured to direct said flexible member to engage a recess to limit travel of said stop member to said intermediate position, when said stop member no longer actuated but biased by said compression spring.

16. The door travel limiting device according to claim 15, further comprising:

a third portion of said track configured to deflect said flexible member in a second direction, when said stop member is actuated to slide from said intermediate position to said second position; and a fourth portion of said track configured to direct said flexible member to avoid said recess, when said stop member is no longer actuated but biased by said compression spring to return said stop member to said first position.

17. The door travel limiting device according to claim 16, further comprising a selectively shaped protrusion on said stop member, and a correspondingly shaped opening on said housing configured to slidably receive said selectively shaped opening of said stop member, to substantially limit said sliding of said stop member to only translation.

18. The door travel limiting device according to claim 17, wherein at least a portion of said stop member comprises a cylindrical shaft.

19. The door travel limiting device according to claim 18, wherein said first protrusion on said stop member comprises a knob.

20. The door travel limiting device according to claim 19, wherein said housing comprises a mounting flange, said mounting flange comprising one or more mounting holes therethrough.

* * * * *